US005088150A

United States Patent [19]

Ritchie

[11] Patent Number: 5,088,150

[45] Date of Patent: Feb. 18, 1992

[54] REPAIR PLATE

[76] Inventor: Gerald B. Ritchie, R. 3, Cynthiana, Ky. 41031

[21] Appl. No.: 545,037

[22] Filed: Jun. 28, 1990

[51] Int. Cl.[5] ..... A47L 9/02

[52] U.S. Cl. ..... 15/377; 15/339; 15/415.1

[58] Field of Search ..... 15/377, 383, 393, 398, 15/415.1, 416, 417, 418, 419, 420, 421, 422, 339

[56] References Cited

U.S. PATENT DOCUMENTS

| | | | |
|---|---|---|---|
| 1,617,103 | 2/1927 | Custer | 15/398 X |
| 2,275,357 | 3/1942 | Gaines | 15/415.1 |
| 2,371,767 | 3/1945 | Lofgren | 15/417 |
| 2,885,717 | 5/1959 | Lampe | 15/417 |

FOREIGN PATENT DOCUMENTS

| | | | |
|---|---|---|---|
| 917476 | 2/1963 | United Kingdom | 15/377 |

*Primary Examiner*—Chris K. Moore
*Attorney, Agent, or Firm*—Warren D. Flackbert

[57] ABSTRACT

A repair plate used in combination with a power nozzle for a vacuum cleaner, typically stamped from metal stock, and serving to repair the power nozzle for reuse purposes. The repair plate may assume the outer configuration of the upper surface of the power nozzle and may be positioned in an operative position by the use of a pop rivet. An air impervious solvent may also be employed to preclude air leakage. The invention solves a long needed problem common to vacuum cleaner repairmen.

5 Claims, 1 Drawing Sheet

REPAIR PLATE

BACKGROUND OF THE INVENTION

As is known, the existence and/or usage of vacuum cleaners has extended over a long period of time, involving various types and forms of mechanisms. Difficulties arise, however, as models age and as substitute components are more difficult to acquire.

A particular trouble area presented within a vacuum cleaner is a power nozzle, i.e. a component which retains the wand for allowing air passage, and, hence, the flow of accumulated dirt and the like, from the carpeted or other surface, for example, to a collection bag. The invention is directed to the preceding component.

DESCRIPTION OF THE INVENTION

In accordance with the teachings of the invention, a repair plate is provided which serves to correct a damaged power nozzle, where, at this time, repair is impossible if the body thereof is cracked along the bottom. The repair plate of the invention is shaped to overlay the reinforcement ridges found on the throat area of the power nozzle and is principally fixed in an operative position by use of a pop rivet. Typically, a clear sealant is utilized to deter air leakage.

In other words, the repair plate provided herein is readily secured to the damaged upper surface of the power nozzle, assembling the power nozzle with the wand so as to allow air passage in the vacuum cleaner.

The overall assembly also provides openings or holes for receiving axles on which the vacuum cleaner wheels are mounted. Thus, the repair plate herein provides significance in readying a vital vacuum cleaner component for reuse in the event of damage, as by cracking.

BRIEF DESCRIPTION OF THE DRAWING

In any event, a better understanding of the present invention will become more apparent from the following description, taken in conjunction with the accompanying drawing wherein.

Figure 1:
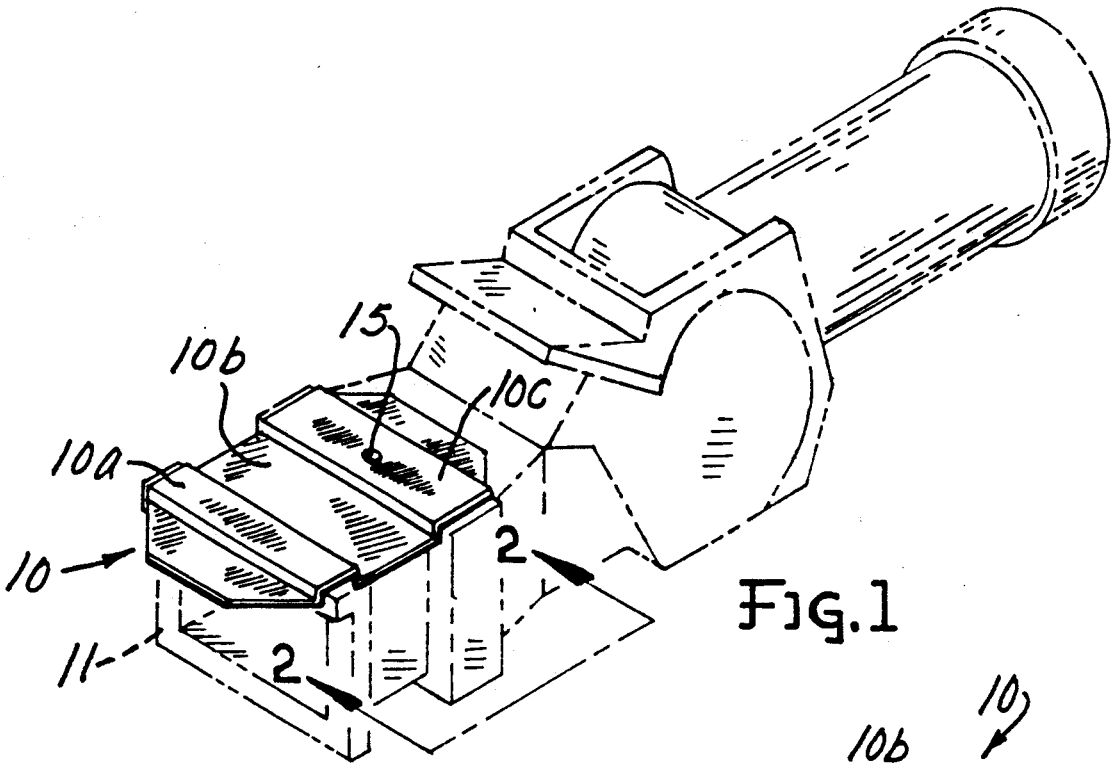
FIG. 1 is a perspective view of a repair plate in accordance with the teachings of the present invention, where the overall assembly, including the power nozzle, is disclosed in phantom for purposes of better understanding.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, repair plate 10 of the invention is disposed, in a typical use condition, on the upper surface of power nozzle 11 (shown in phantom lines in FIG. 1), where the latter forms part of the total vacuum cleaner assembly including a wand for air passage, and, while not detailed, the provision for wheel mounting to permit effective movement of the vacuum cleaner.

Figure 2:
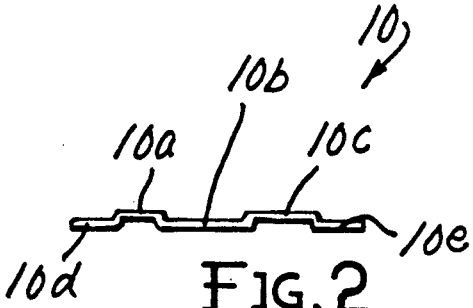
FIG. 2 is a view in side elevation, taken at line 2—2 of FIG. 1 and looking in the direction of the arrows, detailing the instant repair plate; and, FIG. 3 is another perspective view showing the repair plate mounting and the relationship thereof with a typical vacuum cleaner.

As evident in each of the figures, but particularly FIG. 2, the instant repair plate 10, typically a metal stamping, has a unique configuration in side elevation, serving to cooperate shape-wise with reinforcement ridges 11*a* defined on the upper surface of the throat of the power nozzle 11 (shown in phantom in FIG. 1). The repair plate 10 may be secured at an operative position by means of a pop rivet 15. A clear sealant (not shown) is typically employed on the power nozzle 11, preventing any unwanted air leakage.

More specifically, the repair plate 10 includes upstanding reinforcement ridges 10*a* and 10*c*, interconnected by a flat body portion 10*b* and including, at opposite ends, tabs 10*d*, 10*e* projecting away from each other. Some installations may require, depending on vacuum cleaners model, the use of front the tab 10*d*, but with an opening (not shown) therein, to receive optional securement means. In any event, the instant repair plate 10 is readily conformable to repair needs.

Figure 3:
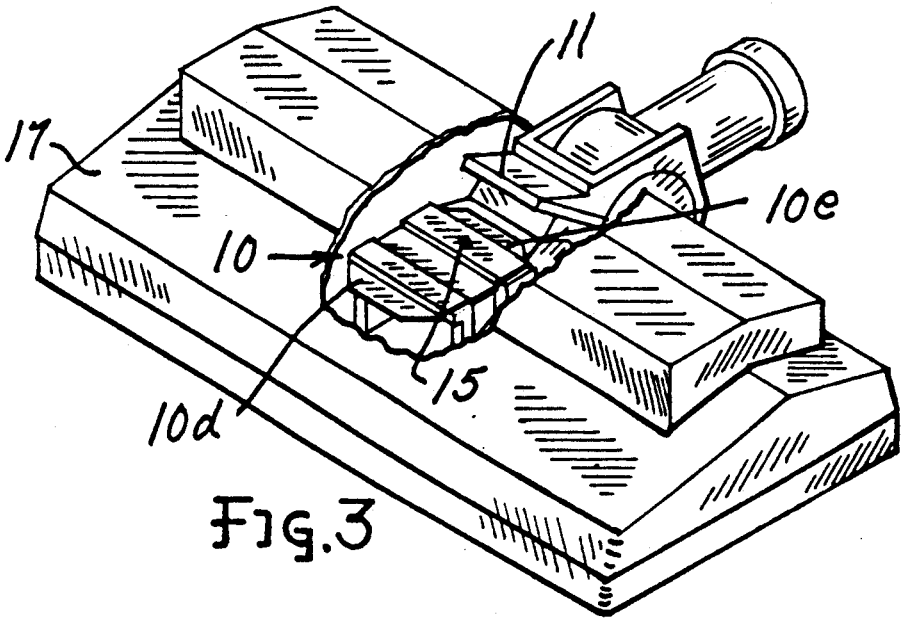

FIG. 3 provides a showing mainly for environmental reasons, including the wheel mounted housing 17 of the typical vacuum cleaner and the power nozzle 11 connecting to the wand described hereabove. Without the provision of the invention, repair is often times impossible and, at most, makeshift. Thus, the repair plate 10 herein satisfies an important need without any necessity of power nozzle 11 remolding (even if possible).

As evident, positive placement ability is inherent and readily accomplished by a repair person. Moreover, since repair plate 10 is typically thin, the transport and storage of such adds further convenience to the invention. Anyone involved with vacuum cleaner repair will immediately realize the import of the invention to satisfy a problem which oftentimes was deemed impossible to correct heretofore.

The repair plate described hereabove is susceptible to various changes within the spirit of the invention, including, by way of example, in proportioning; the provision of ribbed rather than flat surfaces; the planned configuration; the precise securement procedure; and, the like. Thus, the preceding should be considered illustrative and not as limiting the scope of the following claims:

I claim:

1. In combination with a vacuum cleaner including a power nozzle presenting a defective plastic throat having a passageway for airflow, a repair plate comprising a body disposed in the longitudinal direction of said throat and overlying the upper surface thereof, and means securing said body to said throat.

2. The repair plate of claim 1 where said securing means is a pop rivet.

3. The repair plate of claim 1 where said upper surface of said throat includes ridged portions, and where said body conforms to the shape of said ridged portions.

4. The repair plate of claim 1 where a hardening sealant is provided on said throat in an unwanted airflow crack blocking relationship.

5. The repair plate of claim 1 where said body has tab portions facing away from each other at opposite ends thereof.

* * * * *